United States Patent [19]

Dingus

[11] 3,935,776

[45] Feb. 3, 1976

[54] PAPER CUTTING MACHINE

[76] Inventor: James C. Dingus, 175 Kentucky Drive, Newport, Ky. 41071

[22] Filed: Aug. 22, 1974

[21] Appl. No.: 499,549

[52] U.S. Cl. ..... 83/425.4; 83/433; 83/436; 83/476; 83/506

[51] Int. Cl.² ..... B26D 7/06; B26D 1/02

[58] Field of Search ..... 83/425.4, 433, 436, 481, 83/476, 418, 506

[56] References Cited

UNITED STATES PATENTS

| | | | |
|---|---|---|---|
| 1,234,884 | 7/1917 | Dozier et al. | 83/433 |
| 1,695,715 | 12/1928 | Merrick | 83/506 X |
| 2,360,653 | 10/1944 | Davidson | 83/506 |

*Primary Examiner*—Willie G. Abercrombie
*Attorney, Agent, or Firm*—Irwin P. Garfinkle

[57] ABSTRACT

A paper film trimming machine, useful for trimming news copy, consists of a supporting table over which the paper is fed under the weight of a plexiglass plate by means of feed rollers driven by an electric motor. A pair of spring-biased straight-edge knives cut the paper as it travels across a cutting block located between the table and the drive rollers. Each of the knives is mounted on a single threaded shaft and their positions are each independently laterally adjustable to align them accurately with the columns that are being cut.

28 Claims, 5 Drawing Figures

PAPER CUTTING MACHINE

BACKGROUND OF THE INVENTION

In the preparation of newspapers it is the practice to first prepare the articles in the form of headlines and columns exactly as they will appear in the newspaper as printed. In modern newspaper plants this is accomplished by means of computer typesetting and photographic film techniques which serve to type the copy in columns with appropriate headlines. To lay out the newspaper as it will finally appear, the film must be carefully trimmed exactly at the edge of the typed portion, care being taken not to cut the headlines which may be typed with a wider heading. To this day trimming operations are mostly performed by hand. In some modern newspaper facilities machines are used. Typical of prior art machines are those disclosed in Pretz U.S. Pat. No. 3,791,247 and Brown U.S. Pat. No. 3,241,415. Other prior art devices are shown in U.S. Pat. Nos. 246,923, 1,730,196, 2,000,175, 2,360,653 and British Pat. No. 23,952.

All of the prior art patents suffer from various deficiencies, including lack of sufficient speed both in the cutting operation and in the setting up of the film for trimming, and in the lack of accuracy in the trimming operation. Furthermore, the prior art machines are difficult to adjust during operation for columns of varying widths, and for films of different widths.

SUMMARY OF THE INVENTION

The invention is useful in trimming newspaper copy reproduced on film and consisting of printed material arranged in elongated columns of various widths. The trimming machine consists of a supporting table over which the copy is fed under the weight of a plexiglass plate. The film is driven by means of feed rollers around which the film is wrapped. The feed rollers are driven through reduction gearing by means of an electric motor. A pair of spring-biased knives cut the paper as it travels across a cutting block located between the table and the drive rollers. Each knife is a sharpened straight edge terminating in a point. The straight edge is positioned at a slight angle to the cutting block so that approximately half of it passes through the thickness of the film when the film is moved past the point of the knife, the direction of travel being in the direction of the point. Each of the knives is mounted on a single threaded shaft and their positions are each independently adjustable to align them accurately with the columns that are being cut.

DESCRIPTION OF THE ILLUSTRATED EMBODIMENT

Figure 1:
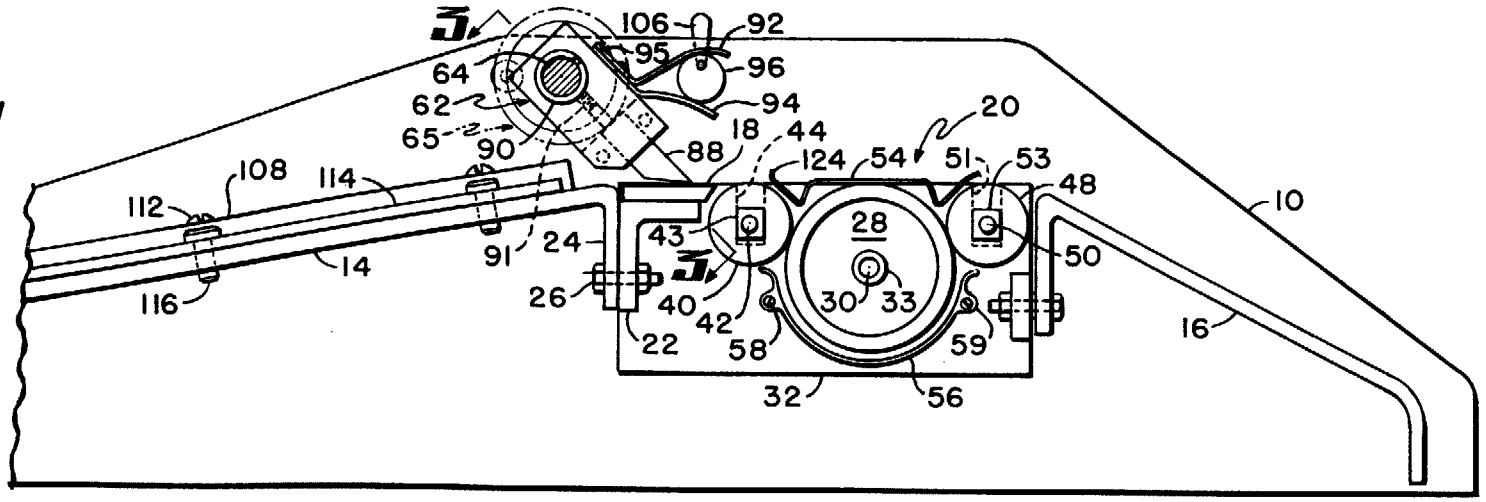
FIG. 1 is a side view of a preferred embodiment of this invention with one of the side walls removed.
Figure 3:
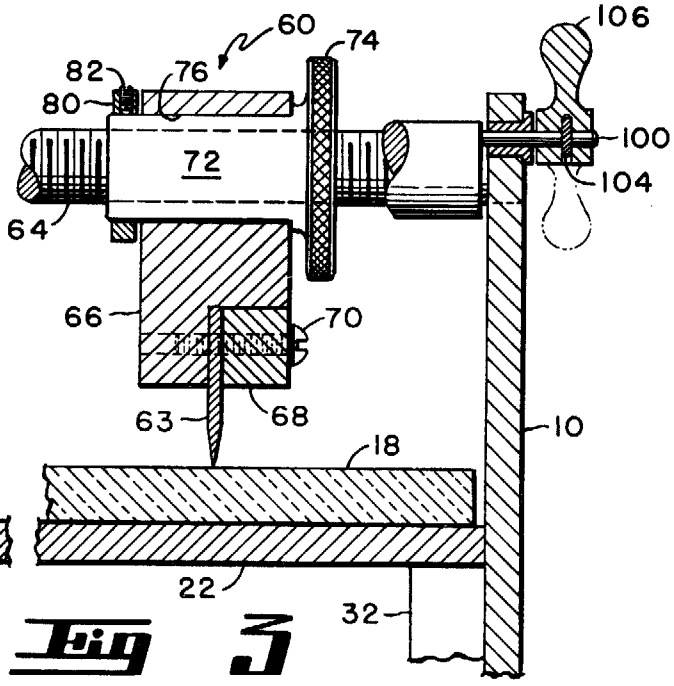
FIG. 3 is a cross section taken through the line 3—3 in FIG. 1 with certain portions added and broken away.

The illustrated paper-trimming machine comprises a frame including two side walls 10 and 12 between which are supported a forward film-supporting ramp or table 14 and a rear film-supporting ramp or table 16. A glass cutting block 18 and a drive system 20 are supported intermediate of forward and rear film-supporting tables. The support for the cutting block 18 comprises L-shaped beam 22 secured between the walls 10 and 12 and to a downwardly depending flange 24 at the rear of the forward table 14 by means of a plurality of suitable fasteners 26.

The drive system 20 comprises a main drive roller 28 fixed on a shaft 30 journaled for rotation in side walls 10 and 12 in bearings 31 and 33. The shaft 30 extends through the side wall 10 and is driven by means of a conventional electric motor 36 through reduction gearing 38. The motor 36 and gears 38 comprise a motor-gear set mounted on the side wall 10 directly to the shaft 30. The main drive roller can also be driven by a hand crank 37 pinned to the shaft 30 by pin 39.

The shaft-supporting slots 44, 46 and 51, 52 are dimensioned so that the forward and rear idler rollers are parallel to and rest in contact with the main roller 28. The idler rollers 40 and 48 are smaller than the main roller 28 but are positioned so that the plane of the cutting block 18 is substantially tangent to each of them.

A pair of mounting blocks 32 and 34 are secured to the side walls for mounting a set of idler rollers. A forward idler roller 40 has a cylindrical shaft 42 rotatably supported in a rectangular bushing 43. The rectangular ends of the shaft are supported in complementary slots 44 and 46 in the block 32 and 34. A rear idler roller 48 has a cylindrical shaft 50 rotatably supported by a rectangular bushing 53. The bushing 53 is supported in complementary slots 51 and 52 in the blocks 32 and 34.

An upper guide 54, supported between the blocks 32 and 34, serves to guide the films onto the roller 40 and off the roller 48. A lower guide 56, secured to the blocks 32 and 34 by means of screws 58 extending through end flanges 59, serves to guide the film onto the main roller 28 and onto the idler roller 48.

The film-trimming device utilizes two cutters, generally indicated at 60 and 62. The left-hand side of the column printed on the film is generally a standard width and therefore the cutter 60 is normally maintained stationary during a trimming operation. However, the right-hand margin of a typed column may have various widths on the film either because different stories are laid out in different column widths or because the headlines accompanying each story may be a different width from the width of the column itself. In either case both the left and right cutter must be made rapidly adjustable so that the location of the cutting edge of each cutter is accurately positioned at the respective edge of a column.

Both of the cutters 60 and 62 are mounted on a threaded shaft 64 journaled for rotation in the side walls 10 and 12. The threaded shaft 64 is rotated manually by means of a crank 65 to which it is fixed by means of a screw 67. The left cutter comprises a knife 63 fixedly held in a complementary slot in a knife-holder block 66 by means of a retainer block 68 and a screw 70. An internally threaded sleeve 72 having an integral disc 74 extends through a cylindrical bore 76 in the knife-holder block 66. The knife-holder block 66 is maintained on the sleeve 72 by means of a locking disc 80 held to the sleeve by means of a set screw 82. The fit between the sleeve 72 and in the knife holder is such that there is a friction fit between these two elements.

The amount of friction between the sleeve 72 and the block 66 is, however, less than the friction between the threaded shaft 64 and the internal threads of the sleeve 72. Thus, when the shaft 64 is rotated by crank 65, the sleeve 72 rotates with the shaft 64 and is not advanced i.e., it does not move laterally. On the other hand, if the disc 74 is manually held by the operator, the sleeve then advances and changes the position of the cutter knife 63.

The cutter 62 comprises a knife-holder block 84 in which a knife 88 is held in a manner similar to that of the knife 63 in the block 66. The knife-holder block 84 has a cylindrical bore in which a split sleeve 90 is press fit. The sleeve 90 is internally threaded onto the shaft 64 and is maintained in fixed relation to it by means of set screw 91. When the shaft 64 is rotated sleeve 90 does not rotate, and therefore the block will move laterally.

Both of the cutters 60 and 62 are vertically biased by means of a pair of leaf springs 92 and 94 attached to the top of the blocks 66 and 84 by means of screws 95. The leaf springs 92 and 94 form tines of a fork, one tine being positioned on top of a cam surface 96 while the other is located at the bottom of the cam surface 96. The cam surface 96 is a cylindrical shaft having an eccentric axis of rotation defined by off-center pins 100 and 102. The pins 100 and 102 are supported between the side walls 10 and 12, the pin 100 being connected by means of a pin 104 to a lever 106.

Figure 4:
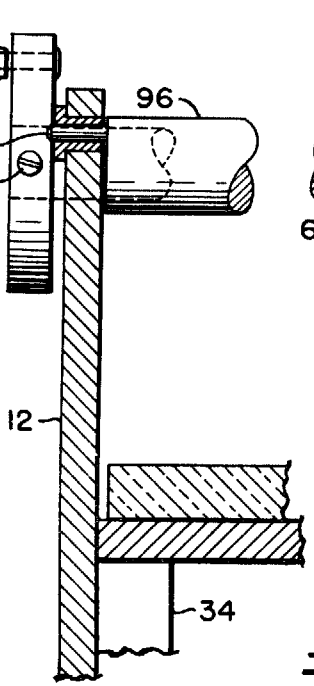
FIG. 4 is a cross-sectional view showing the spring-biasing means for the knives.
Figure 5:
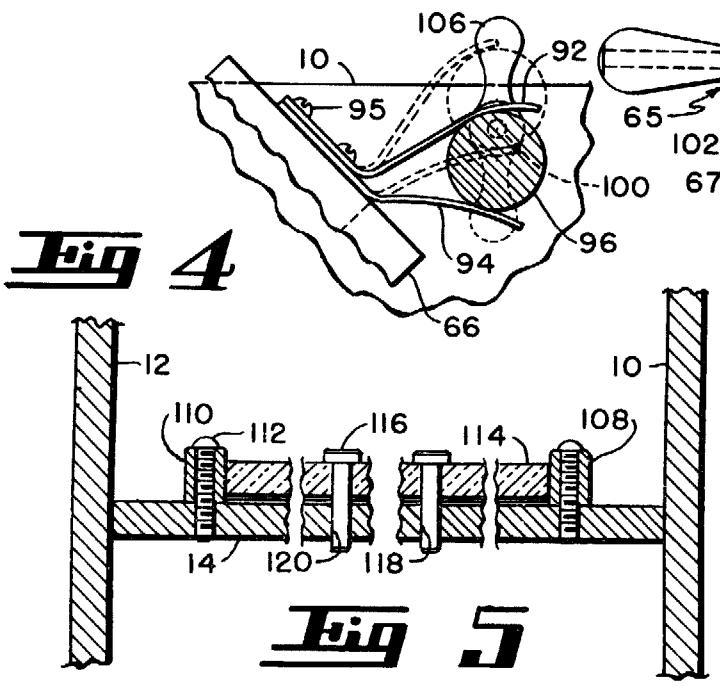
FIG. 5 is a cross section taken through the line 5—5 in FIG. 2.
Figure 2:
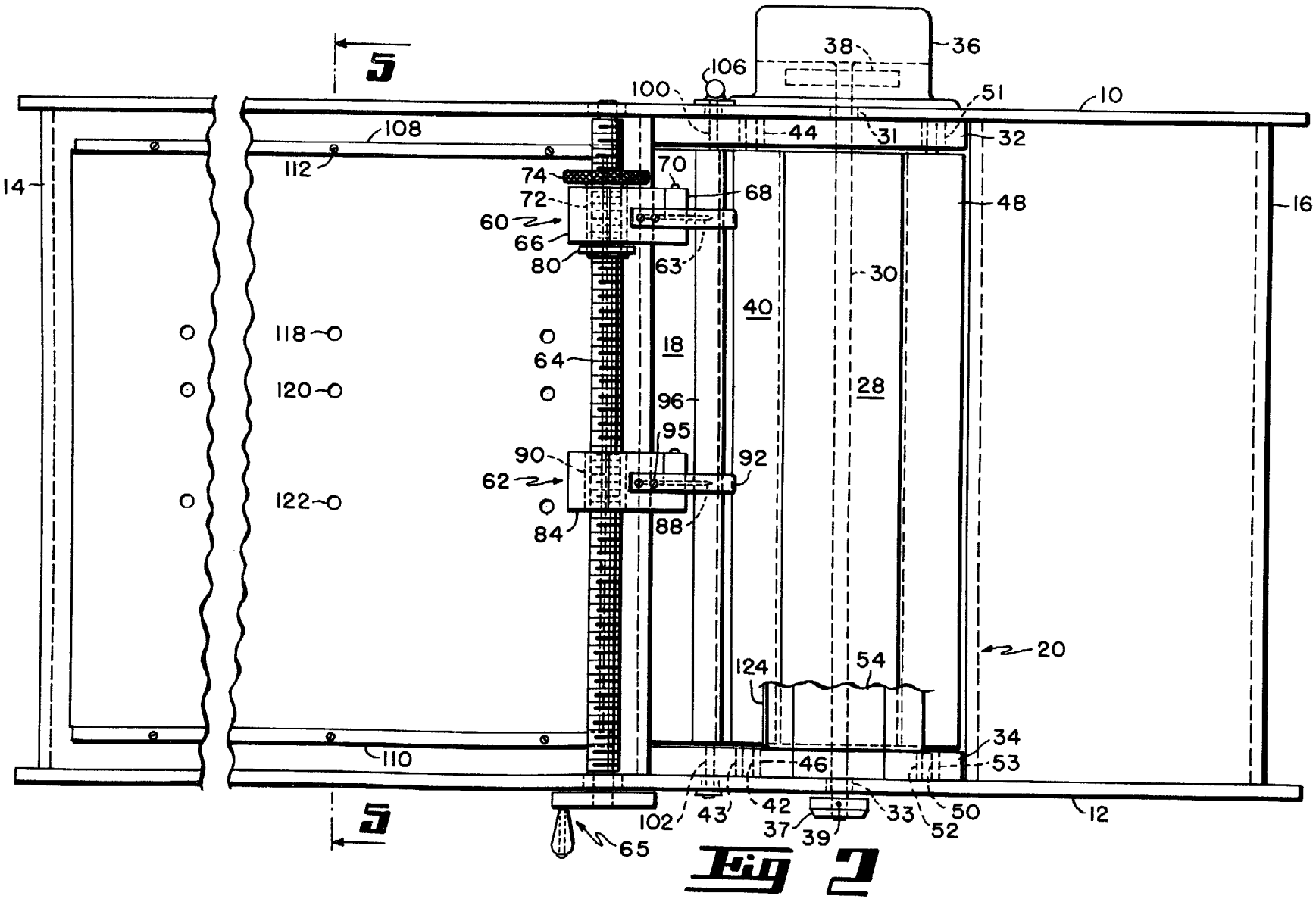
FIG. 2 is a plan view of FIG. 1.

When the cam 96 is in the position shown in solid lines in FIG. 4, the springs 92 and 94 are forced down driving the knives 63 and 88 onto the cutting block 18. When the cam 96 is rotated by the lever 106 to the position shown in dotted lines, the knives 63 and 88 are raised from the cutting block 18.

The guide system for the films comprises a pair of tracks 108 and 110 secured to the forward table 14 by screws 112. In an embodiment of the invention as reduced to practice, the distance between the tracks provides a loose fit for standard 8-inch size film. When the film is laid between the tracks 108 and 110, it is then covered and held down at the cutting block by a transparent plastic plate 114 and which provides a drag on the film to prevent wrinkles or bubbles forming at the cutting block.

For the purpose of accommodating film of smaller, but standard, sizes I use a series of cylindrical pegs 116 inserted in aligned holes 118, 120 or 122 in the table 14. Pegs 116 inserted in the holes 118 provide a right-hand guide for the smallest width film, while the pegs 116 inserted in the holes 120 or 122 provides guides for larger sizes, all of which are "standard" in the news-printing industry.

As seen in FIG. 1, complementary holes are also provided in the plate 114 through which the pins 116 are inserted after the plate is in place over the film.

To operate the film-cutting device, a roll of film is manually threaded past the knives 63 and 88 (in their raised positions) and between the forward lip 124 of upper guide 54. By means of the hand crank 37 or the motor 36, the film is taken up by the rollers 40 and 28 and driven into the lower guide 56. From there the film is taken up by the rollers 28 and 48 and driven onto the rear table 16.

An important detail of this invention is the positioning of the knives 63 and 88. For efficient cutting the knife edge of each knife should be at an angle to the cutting block. The size of the angle should be such that approximately one-half of the knife penetrates the film to the block 18. While the angle is not critical, it is imperative that the rear portion of the knife edge not be in contact with the film.

Another important detail of this invention is in the alignment of the top of the front table 14, and the tangential relationship of the cutting block with the peripheries of the rollers. This relationship is such that the film is pulled without raising it from the cutting block, thus avoiding film tearing. In addition, this arrangement of rollers provides more than 180° of wrap of the film around the drive roller 28. Therefore, once the film is started across the block 18 in a straight line there is little chance of subsequent misalignment.

The use of straight-edged stationary knives is also important. First of all, the knives are expendably cheap and easily replaced when dull. Second, the knives do not drive the film and therefore do not effect its steering. The rollers simply draw the film past the knives in a straight line. The tracks 108 and 110 and the pins 116 serve to provide initial alignment.

The system for laterally adjusting the knives is fast and accurate in that the knives can be moved separately or together. The left knife 63 can be adjusted by either holding the disc 74 while turning the shaft 64 or it can be adjusted by turning the disc 74 and holding the shaft.

In operation, as the film moves through the device it is cut simultaneously by both knives 63 and 88. Cutting can be stopped almost instantly by turning the lever 106. If it is desired to cut only one side of the column one of the knives can be moved off to the side.

Various modifications and adaptations will be apparent to persons skilled in the art and it is therefore my intention that the invention be limited only by the appended claims.

I claim:

1. For use in trimming copy reproduced on a paper, said copy consisting of printed material arranged in elongated columns, the combination comprising:

a frame having spaced side support means;

a forward paper support table mounted between said side support means;

paper driving means mounted aft of said forward table;

a paper cutting block between said forward table and said paper driving means;

first and second knives, each having a sharpened straight cutting edge terminating at a point, said straight edges being biased against said cutting block at a slight angle thereto, the straight cutting edges of said knives being parallel to the direction of travel of said film;

adjusting means for independently adjusting the lateral positions of each of said knives to align said knives with the edges of said columns; and said paper driving means comprising a drive roller, a forward idler roller and a rear idler roller, all of said rollers being supported between said side supporting means with their axes parallel, said idler rollers resting on said drive roller, the plane of said cutting block being substantially tangent to all of said rollers, whereby said paper is wrapped around said idler rollers and at least 180° of said drive roller.

2. The invention as defined in claim 1, and elevating means for raising both of said knives from said block.

3. The invention as defined in claim 1 wherein said knives are releasably secured within knife holders, said knife holders being pivotally mounted above said paper-cutting block.

4. The invention as defined in claim 3, and a cam comprising:

a cylindrical shaft mounted between said walls adjacent said knife holders, said shaft being rotatably mounted on an axis eccentric to the axis of said cylinder; and a cam follower connected between each of said knife holders and said cam for positively moving said knives into and out of engagement of said cutting block when said cam is rotated.

5. For use in trimming copy reproduced on a paper, said copy consisting of printed material arranged in elongated columns, the combination comprising:

a frame having spaced side support means;

a forward paper support table mounted between said side support means;

paper driving means mounted aft of said forward table;

a paper cutting block between said forward table and said paper driving means;

first and second knives, each having a sharpened straight cutting edge terminating at a point, said straight edges being biased against said cutting block at a slight angle thereto, the straight cutting edges of said knives being parallel to the direction of travel of said film, said knives being releasably secured within knife holders, said knife holders being pivotally mounted above said paper-cutting block;

adjusting means for independently adjusting the lateral positions of each of said knives to align said knives with the edges of said columns;

a cam comprising a cylindrical shaft mounted between said walls adjacent said knife holders, said shaft being rotatably mounted on an axis eccentric to the axis of said cylinder; and a cam follower connected between each of said knife holders and said cam for positively moving said knives into and out of engagement of said cutting block when said cam is rotated, each of said cam follower comprising a forked spring secured to a knife holder, said spring having two tines, one contacting the upper surface of said cam, the other contacting the lower surface of said cam.

6. The invention as defined in claim 5 wherein said tines are leaf springs.

7. The invention as defined in claim 1 wherein said adjusting means comprises:

a threaded shaft rotatably mounted between said side walls; and a knife holder for each of said knives, each of said holders having a bore with internal threads, said holders being threaded onto said threaded shaft.

8. The invention as defined in claim 1 wherein said adjusting means comprises:

a threaded shaft rotatably mounted between said side walls;

a first and a second knife holder for said first and second knives, respectively, each of said holders having a cylindrical bore; and an internally threaded sleeve in each bore, said sleeves being threaded onto said threaded shaft.

9. The invention as defined in claim 8 wherein said sleeve for said first knife holder includes an integral enlarged disc, the friction between said sleeve and said knife holder being less than the friction between the threads of said sleeve and said threaded shaft, whereby said sleeve rotates with said shaft, and does not advance axially, except when said disc is held as said shaft is rotated.

10. The invention as defined in claim 9, wherein said sleeve for said second knife holder is slotted, a locking screw extending through said knife holder into contact with said sleeve for adjusting the friction between said holder, said sleeve and said threaded shaft.

11. The invention as defined in claim 1 and a pair of tracks on said table, said tracks providing a guide for the paper to be trimmed.

12. The invention as defined in claim 11, and a transparent plate freely supported on said table between said guides, said paper running on said table under said plate.

13. The invention as defined in claim 12, and a set of holes in said plate;

a complementary set of holes in said table; and a peg extending through each hole in said plate and its complement in said table, said holes being aligned in the direction of travel of paper to be trimmed, said pegs providing a guide for one edge of said paper.

14. The invention as defined in claim 13 wherein there is a plurality of sets of holes and their complements arranged in spaced rows, said pegs being placed in a selected row.

15. The invention as defined in claim 1 and a drive motor, coupled to said drive roller, said motor being mounted on said side wall, said motor and said roller being coaxial.

16. The invention as defined in claim 6 wherein said adjusting means comprises:

a threaded shaft rotatably mounted between said side walls;

a knife holder for each of said knives, each of said holders having a bore with internal threads, said holders being threaded onto said threaded shaft.

17. The invention as defined in claim 6 wherein said adjusting means comprises:

a threaded shaft rotatably mounted between said side walls;

a first and a second knife holder for said first and second knives, respectively, each of said holders having a cylindrical bore; and an internally threaded sleeve in each bore, said sleeves being threaded onto said threaded shaft.

18. The invention as defined in claim 17 wherein said sleeve for said first knife holder includes an integral enlarged disc, the friction between said sleeve and said knife holder being less than the friction between the threads of said sleeve and said threaded shaft, whereby said sleeve rotates with said shaft and does not advance axially except when said disc is held as said shaft is rotated.

19. The invention as defined in claim 18 wherein said sleeve for said second knife holder is slotted, a locking screw extending through said knife holder into contact with said sleeve for adjusting the friction between said holder, said sleeve and said threaded shaft.

20. The invention as defined in claim 19 and a pair of tracks on said table, said tracks providing a guide for the paper to be trimmed.

21. The invention as defined in claim 20, and a transparent plate freely supported on said table between said guides, said paper running on said table under said plate.

22. The invention as defined in claim 21, and a set of holes in said plate;

a complementary set of holes in said table; and a peg extending through each hole in said plate and its complement in said table, said holes being aligned in the direction of travel of paper to be trimmed, said pegs providing a guide for one edge of said paper.

23. The invention as defined in claim 22 wherein there is a plurality of sets of holes and their complements arranged in spaced rows, said pegs being placed in a selected row.

24. The invention as defined in claim 23 wherein:

said paper driving means comprises a drive roller; and means for wrapping said paper around at least 180° of said drive roller.

25. The invention as defined in claim 24 and a forward idler roller and a rear idler roller, all of said rollers being supported between said side walls with their axis parallel, said idler rollers resting on said drive roller, the plane of said cutting block being substantially tangent of all of said rollers.

26. The invention as defined in claim 25 and a drive motor, coupled to said drive roller, said motor being mounted on said side wall, said motor and said roller being coaxial.

27. The invention as defined in claim 1 wherein said forward paper supporting table is an ascending ramp.

28. The invention as defined in claim 27, and a rear paper supporting table aft of said paper driving means, said rear paper supporting table being a descending ramp.

* * * * *